US005954327A

United States Patent [19]

Lin et al.

[11] Patent Number: 5,954,327

[45] Date of Patent: Sep. 21, 1999

[54] PAPER-FEEDING APPARATUS

[75] Inventors: Chin-I Lin, Taoyuan Hsien; Jung-Ting Hsia, Hsinchu; Wen-Jso Tseng, Taichung, all of Taiwan

[73] Assignee: Umax Data Systems Inc., Hsinchu, Taiwan

[21] Appl. No.: 09/055,234

[22] Filed: Apr. 6, 1998

[51] Int. Cl.[6] ..... B65H 7/08

[52] U.S. Cl. ..... 271/110; 271/118; 271/126; 271/155; 271/157

[58] Field of Search ..... 271/118, 126, 271/110, 157, 160, 152, 155

[56] References Cited

U.S. PATENT DOCUMENTS 5,351,945 10/1994 Asakawa et al. ..... 271/118

5,386,983 2/1995 Ando ..... 271/118

5,419,543 5/1995 Nakamura et al. .

*Primary Examiner*—David H. Bollinger

*Attorney, Agent, or Firm*—Bacon & Thomas

[57] ABSTRACT

Paper sheets are fed through a printing machine by a compact apparatus including a feeding mechanism having a paper-fetching gear set, a toothed bar meshed with the gear set, a motor driving the feeding mechanism, a paper tray, a support shaft axially coupled to the paper tray, a lifting member pivotally coupled to the shaft and an actuator for driving the lifting member to move either towards or away from the paper fetching gear set.

14 Claims, 10 Drawing Sheets

PAPER-FEEDING APPARATUS

BACKGROUND OF THE INVENTION

1. Field of the Invention

This invention relates in general to a paper-feeding apparatus for use on a printing machine, such as a computer printer, a copy machine, a fax machine, and the like, to feed paper sheets through the printing process.

2. Description of Related Art

A conventional paper-feeding apparatus for use on an inkjet printer is disclosed in U.S. Pat. No. 5,419,543 to Nakamura et al., which is illustrated in FIGS. 10–11.

As shown in FIG. 10, the paper-feeding apparatus of U.S. Pat. No. 5,419,543 includes a printer body 1, a paper guiding path 90, a paper setting mechanism 10, a paper feeding mechanism 20, a printing head 3, a paper delivery mechanism 91, and a paper receiving portion 7. Moreover, on the printer body 1, there is provided a drive gear mechanism 50 which uses a motor 51 to drive both the paper setting mechanism 10 and the paper feeding mechanism 20. Further, the rotational direction of the motor 51 is controlled by a drive control means 70.

Referring further to FIG. 11, the drive gear mechanism 50 includes a motor 51, a pinion gear 52 axially mounted on the shaft of the motor 51, a first gear portion (including a cam gear 53 and an intermediate gear 54) coupled to a cam member 14 on the paper setting mechanism 10, a second gear portion (including a paper feeding gear 55) meshed to the feed roller 21 on the paper feeding mechanism 20, and a selective power transmission portion 61. Further, the selective power transmission portion 61 includes a sun gear (a power transmission mechanism) 62 meshed to the pinion gear 52; a swing mechanism (a selecting mechanism) 63 axially coupled to the shaft 62*a* of the sun gear 62 and rotatable in the same direction as the sun gear 62; and a planet gear can adjacent power transmission mechanism 64 provided on the swing mechanism 63 and meshed to the sun gear 62.

When the motor 51 drives the pinion gear 52 to rotate in the clockwise direction, the sun gear 62 in the selective power transmission portion 61 will be forced to rotate in the counterclockwise direction. This causes the swing mechanism 63 to swing in the counterclockwise direction and the planet gear 64 to be meshed to the intermediate gear 54 in the first gear portion. As a result, the power from the motor 51 is transmitted to the cam member 14, causing the cam member 14 to rotate in the clockwise direction as indicated by the arrow in FIG. 11. At this time, if the cam member 14 is disengaged from the cam-contacted surface 11*c* on the bottom of the paper tray 11, the spring 13 will urge upwards against paper tray 11, causing the paper tray 11 to come into abutment on the feed roller 21, thereby allowing the sheets in the paper tray 11 to be fed in by the feed roller 21. Otherwise, if the cam member 14 is in contact with the cam-contacted surface 11*c*, the cam member 14 will urge downwards against the paper tray 11, thereby compressing the spring 13 and causing the paper tray 11 to withdraw from the feed roller 21.

On the other hand, when the motor 51 drives the pinion gear 52 to rotate in the counterclockwise direction (as indicated by the arrow in FIG. 11), it will drive the sun gear 62 to rotate also in the counterclockwise direction, causing the swing mechanism 63 to swing in the clockwise direction. This then causes the planet gear 64 to be meshed to the paper feeding gear 55 in the second gear portion. As a result, the power from the motor 51 is transmitted to the feed roller 21, causing the feed roller 21 to rotate in the clockwise direction. At this time, if the paper tray 11 is in abutment on the feed roller 21, the topmost sheet in the paper tray 11 will be drawn out by the feed roller 21 to be fed into the printing process.

The aforementiones paper-feeding apparatus is specifically designed to use just one driving motor instead of two as in more conventional apparatuses to drive the paper setting mechanism and paper feeding mechanism of a printing means. The use of two driving motors would increase the structural complexity of the apparatus, and thus increase the manufacturing cost. Although the aforementiones paper-feeding apparatus can solve this problem, it nonetheless has some other drawbacks. The patented apparatus utilizes two sets of transmission mechanisms, i.e., the drive gear mechanism 50 and the selective power transmission portion 61, which increase the structural complexity of the apparatus. The pronounced structural complexity highters the manufacturing cost and the makes the resultant apparatus bulky in size. Furthermore, the use of a single-directional clutching mechanism in place of the swing mechanism 63 also increases the structural complexity and thus the manufacturing cost of the apparatus.

SUMMARY OF THE INVENTION

It is therefore an objective of the present invention to provide a paper-feeding apparatus, which can be constructed without using two sets of transmission mechanisms so as to simplify, the mechanical structure to a more compact size.

It is another an objective of the present invention to provide a paper-feeding apparatus, which can be manufactured with a further reduced manufacturing cost as compared to the prior art.

In accordance with the aforementiones and other objectives of the present invention, an improved paper-feeding apparatus is provided. The paper-feeding apparatus is devised for use on a printing machine, such as a computer printer, a copy machine, a fax machine or the like, to feed paper sheets through the printing process. The paper-feeding apparatus of the invention includes the following constituent parts:

(a) a paper feeding mechanism including a paper-feeding gear set, and a toothed bar meshed to the paper-fetching gear set;

(b) motor means for driving the paper feeding mechanism;

(c) a paper setting mechanism including a paper tray, a support shaft axially coupled to the paper tray, a lifting member pivotally coupled to the support shaft, and an actuator for driving the lifting member to move either towards or away from the paper-fetching gear set; the actuator driving the lifting member away from the paper-fetching gear set when the actuator is being urged by the toothed bar, and coming into abutment on the paper-fetching gear set when not subjected to the urging force from the toothed bar; and (d) a paper sensor, mounted proximate to the paper-fetching gear set, for detecting whether a sheet is being printed thereby selectively controlling the motor means to rotate in either direction.

The shaft of the motor is coupled to drive both the paper-fetching gear set and the toothed bar. When the paper-fetching gear set is driven to rotate, it drags sheets one by one into the printing position. When the toothed bar is driven to shift, it can urge the lifting member to either come into abutment on the paper-fetching gear set for paper feeding or withdraw from the paper-fetching gear set easy for the apparatus to fetch the next sheet.

The actuator can be a coil spring or an elastic cylindrical member. Alternatively, the actuator comprises a pivotal member pivotally mounted on a shaft on one side of the lifting member and is substantially an L-shaped member having an upper part and bottom part; and a spring having a top end affixed to the lifting member. Various other modifications are possible.

BRIEF DESCRIPTION OF DRAWINGS

The invention can be more fully understood by reading the following detailed description of the preferred embodiments, with reference made to the accompanying drawings, wherein.

DETAILED DESCRIPTION OF PREFERRED EMBODIMENTS

In accordance with the invention, various preferred embodiments are disclosed in the following.

First Preferred Embodiment

Figure 2:
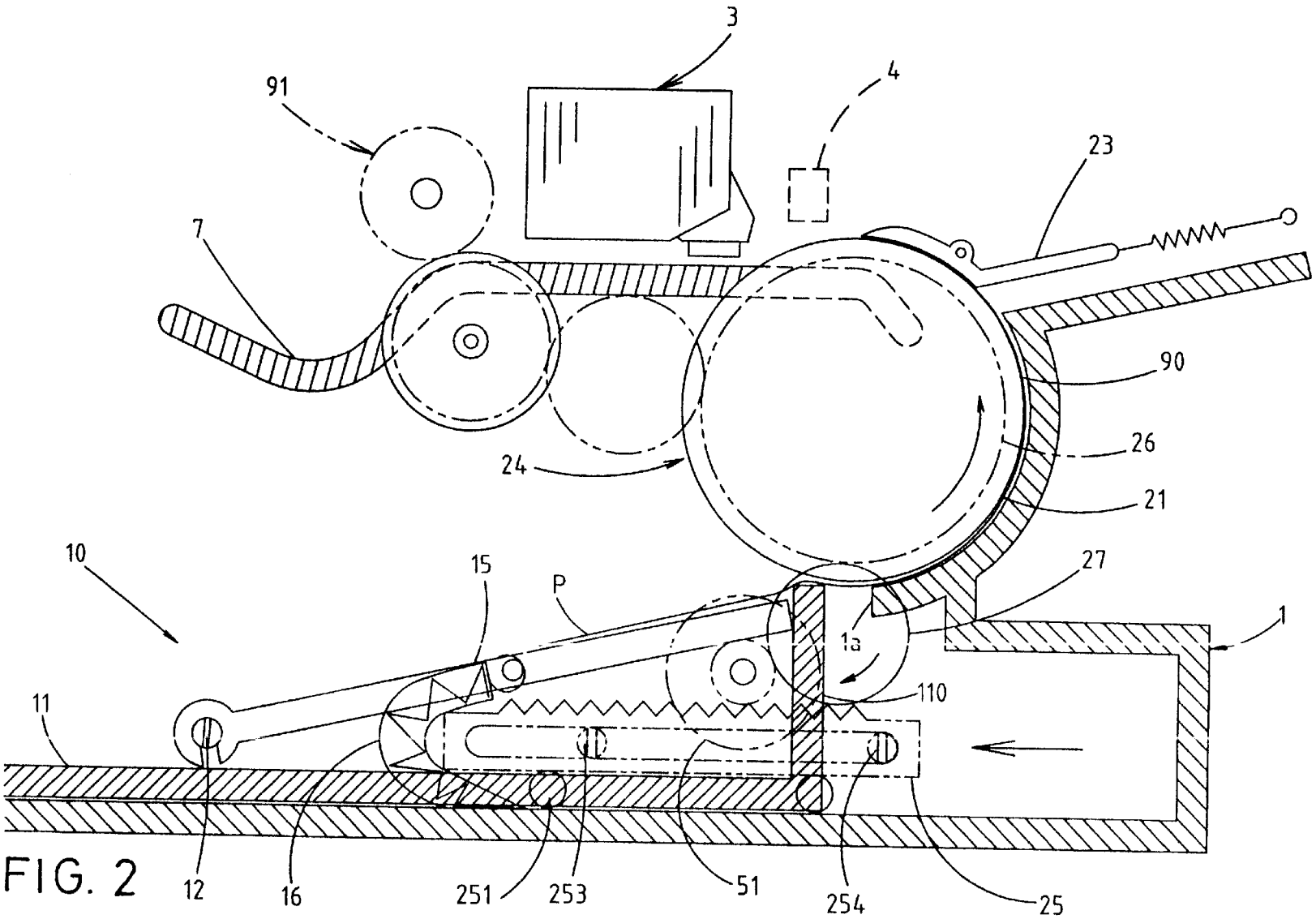
FIG. 2 shows the same of FIG. 1 when the lifting member is withdrawn from the feed roller during the feeding of the sheet through the printing position.
Figure 3:
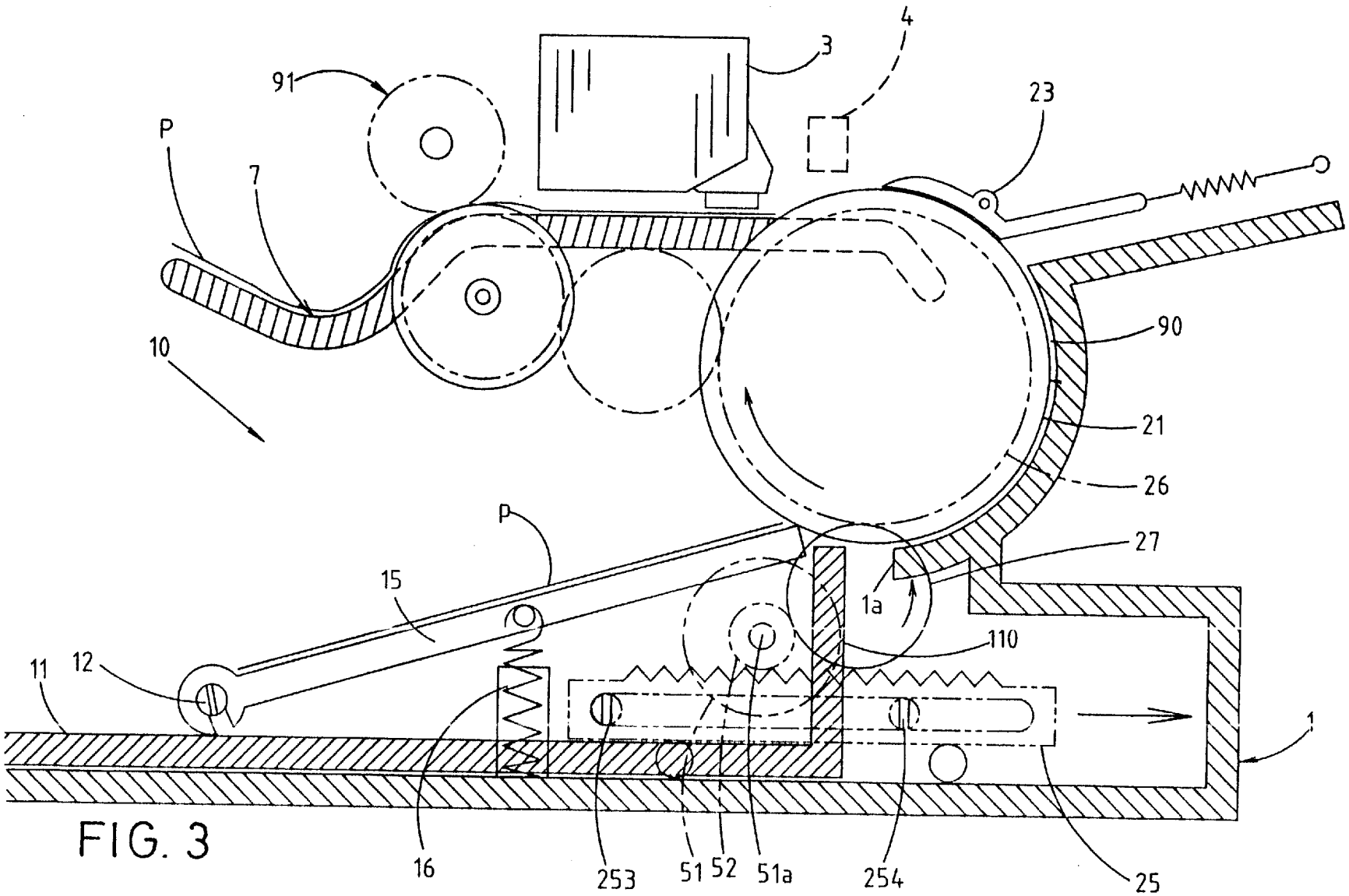
FIG. 3 shows the same of FIG. 1 when the lifting member is restored again to abut on the feed roller so as to fetch the next sheet.
Figure 10:
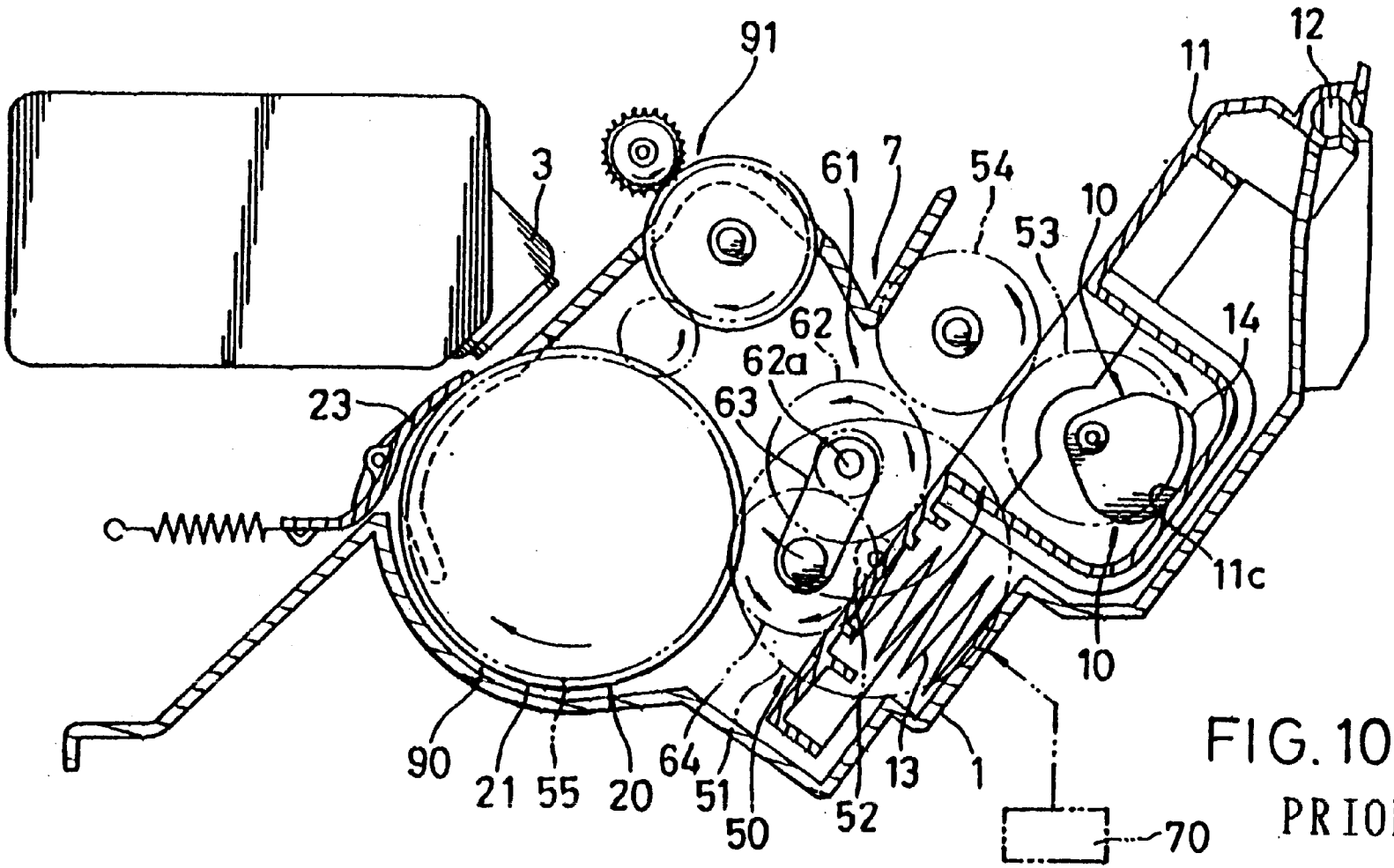
FIG. 10 PRIOR ART
FIG. 10 is a schematic sectional view of a conventional paper-feeding apparatus when the lifting member is withdrawn from the feed roller.
Figure 11:
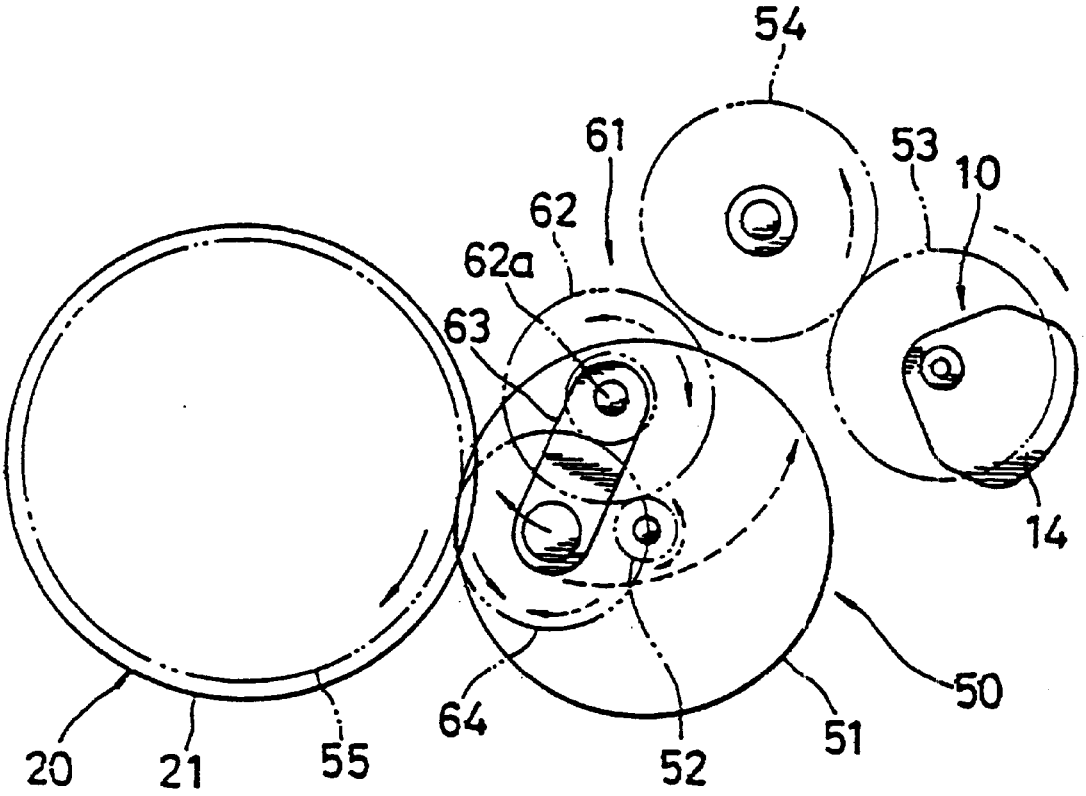
FIG. 11 PRIOR ART
FIG. 11 is a schematic diagram of a drive gear mechanism utilized in the conventional paper-feeding apparatus of FIG. 10.

The first preferred embodiment of the paper-feeding apparatus according to the invention is disclosed in the following with reference to FIGS. 1–3. In these drawings, the constituent parts that are similar in structure and function to those shown in the prior art of FIGS. 10–11 are labeled with the same reference numerals. This embodiment is devised for use, for example, on an inkjet printer.

As shown, the first preferred embodiment of the paper-feeding apparatus according to the invention includes a printer body 1 which is provided with a paper setting mechanism 10, a motor 51, a paper feeding mechanism 20, a paper sensor 4, a printing head 3, a paper delivery mechanism 91, and a paper receiving portion 7.

The paper setting mechanism 10 includes a paper tray 11 having an upright wall 110 attached to the front side of the paper tray 11; a support shaft 12 axially coupled to the paper tray 11; a lifting member 15 pivotally coupled to the support shaft 12 an on which a pile of sheets can be placed; an actuator 16 for driving the lifting member 15 to move either upwards or downwards. The actuator 16 is composed of a coil spring 161 and a flexible sleeve 162 fitted on the coil spring 161. Alternatively, the coil spring 161 can be replaced by an elastic cylindrical body. The coil spring 161 has a top end 161*a* affixed to one lateral side (or the bottom side) of the lifting member 15, and a bottom end 161*b* affixed to the bottom side of the printer body 1. When the actuator 16 is subjected to no external force, it is positioned in such a manner as to urge against the lifting member 15, allowing the lifting member 15 to maintain abutment on the paper feeding mechanism 20 (see FIG. 1 and FIG. 3).

The paper feeding mechanism 20 includes a paper-fetching gear set 24 and a toothed bar 25 meshed to the paper-fetching gear set 24. The paper-fetching gear set 24 includes a feed roller 21, a feed gear 26 axially coupled to the feed roller 21, and an intermediate gear 27 meshed to the bottom side of the feed gear 26. The intermediate gear 27 is meshed to the toothed bar 25 and the pinion gear 52 on the shaft 51*a* of the motor 51. When the motor 51 drives the pinion gear 52 to rotate in the clockwise direction (with respect to the view of FIG. 1), it will cause the intermediate gear 27 to rotate in the counterclockwise direction, and the feed gear 26 to rotate in the clockwise direction. This then causes the toothed bar 25 to be shifted to the right (with respect to the view of FIG. 1). On the other hand, when the motor 51 drives the pinion gear 52 to rotate in the counterclockwise direction (with respect to the view of FIG. 1), it will cause the intermediate gear 27 to rotate int he clockwise direction, and the feed gear 26 to rotate in the counterclockwise direction. This then causes the toothed bar 25 to be shifted to the left (with respect to the view of FIG. 1). The left-shifting toothed bar 25 will then urge against the actuator 16, thereby causing the actuator 16 to pivot the lifting member 15 about the support shaft 12 toward the bottom. As a result of this, the lifting member 15 is activates urged to withdraw from the feed roller 21 in the paper-fetching gear set 24 (see FIG. 2).

Further, a pressing member 23 is provided near the top of the feed roller 21 for pressing the feeding sheet firmly against the feed roller 21 so as to allow the feed roller 21 to more easily drag the sheet into the printing position beneath the printing head 3. The paper sensor 4 is provided between the pressing member 23 and the printing head 3 to sense if any sheet is being fed through the apparatus. When the sheet is passing through the printing position, the paper sensor 4 will not be activated. When the paper sensor 4 senses that the tail of the sheet has left the printing position, it will after a preset time period generate a trigger signal to the motor 51. In response to this trigger signal, the motor 51 will change its rotating direction from the counterclockwise direction to the clockwise direction, thereby causing the toothed bar 25 to be shifted in the reverse direction to the right (with respect to the view of FIG. 3). As a result of this, the force exerted on the actuator 16 is gradually released until the toothed bar 25 is completely withdrawn from the abutment on the actuator 16. At the same time, the elasticity from the compressed coil spring 161 will urge against the lifting member 15, causing the lifting member 15 to come into abutment on the feed roller 21, thus being put into a position ready to receive the next sheet (see FIG. 3).

In this preferred embodiment, a plurality of pulleys 251 are provided on the bottom of the toothed bar 25 so as to facilitate the shifting of the toothed bar 25 driven by the motor 51. Alternatively, sliding tracks (not shown) can be provided instead of the pulleys 251. Moreover, a guide slot 252 is formed in the length of the toothed bar 25 for a pair of stop pins 253, 254 formed on the sidewall of the printer body 1 to be fitted therein. When the toothed bar 25 is shifting to the left, it will be stopped when the right stop pin 254 reaches the rightmost end of the guide slot 252; and when the toothed bar 25 is shifting to the right, it will be stopped when the left stop pin 253 reaches the leftmost end of the guide slot 252. This allows the toothed bar 25 to be shiftable only within the range defined by the left and right stop pins 253, 254; in this range, the toothed bar 25 is still in contact with the intermediate gear 27.

Figure 1:
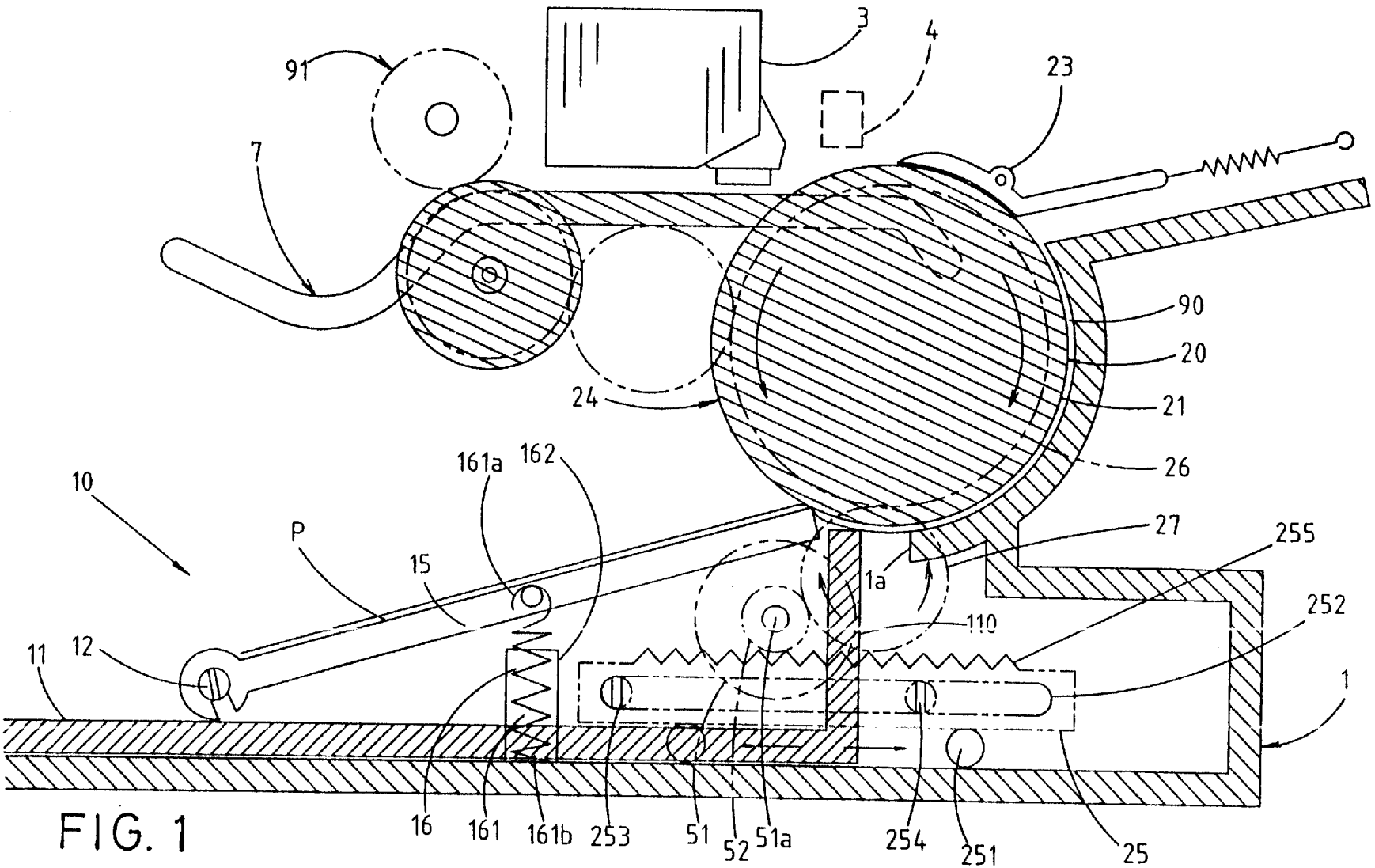
FIG. 1 is a schematic sectional view of a first preferred embodiment of the paper-feeding apparatus according to the invention when the lifting member is abutted on the feed roller to fetch a sheet of paper.

In operation, the paper sensor 4 issues a trigger signal to the motor 51 to command the motor 51 to drive the feed roller 21 to rotate in the counterclockwise direction, thereby causing the feed roller 21 to drag the topmost sheet P on the lifting member 15 into the paper guiding path 90 formed between the feed roller 21 and the printer body 1 (see FIG. 1). As the sheet P is being dragged along the paper guiding path 90, the motor 51 drives the toothed bar 25 to shift to the left to urge against the actuator 16, thereby causing the actuator 16 to move the lifting member 15 downwards, thus withdrawing the lifting member 15 from the feed roller 21. Once the lifting member 15 is withdrawn from the feed roller 21, the next sheet will not be dragged into the paper guiding path 90 by the feed roller 21. At the same time, the motor 51 keeps driving the feed roller 21 to feed the sheet P through the printing position (see FIG. 2), allowing the printing head 3 to print data on the sheet P. When the paper sensor 4 senses that the tail end of the sheet has left the printing position, it will after a present time period generate a trigger signal to the motor 51. In response to this trigger signal, the motor 51 will change its rotating direction from the counterclockwise direction to the clockwise direction, thereby causing the toothed bar 25 to be shifted in the reverse direction to the right and withdraw from the abutment on the actuator 16. At the same time, the elasticity from the compressed coil spring 161 will urge against the lifting member 15, thereby causing the lifting member 15 to come into abutment on the feed roller 21, thus being put into a position ready to receive the next sheet (see FIG. 3). The next sheet will then be dragged into the paper guiding path 90 by the feed roller 21 when the motor 51 is started the next time. On the other hand, if the paper sensor 4 detects that no sheet is being fed in by the feed roller 21 into the paper guiding path 90, it will then command the motor 51 to rotate in the reverse direction so as to drive the lifting member 15 back to the ready position; and this, paper sensor 4 will command the motor 51 to rotate in the forward direction so as to cause the feed roller 21 to drag the sheet into the paper guiding path 90.

Second Preferred Embodiment

Figure 4:
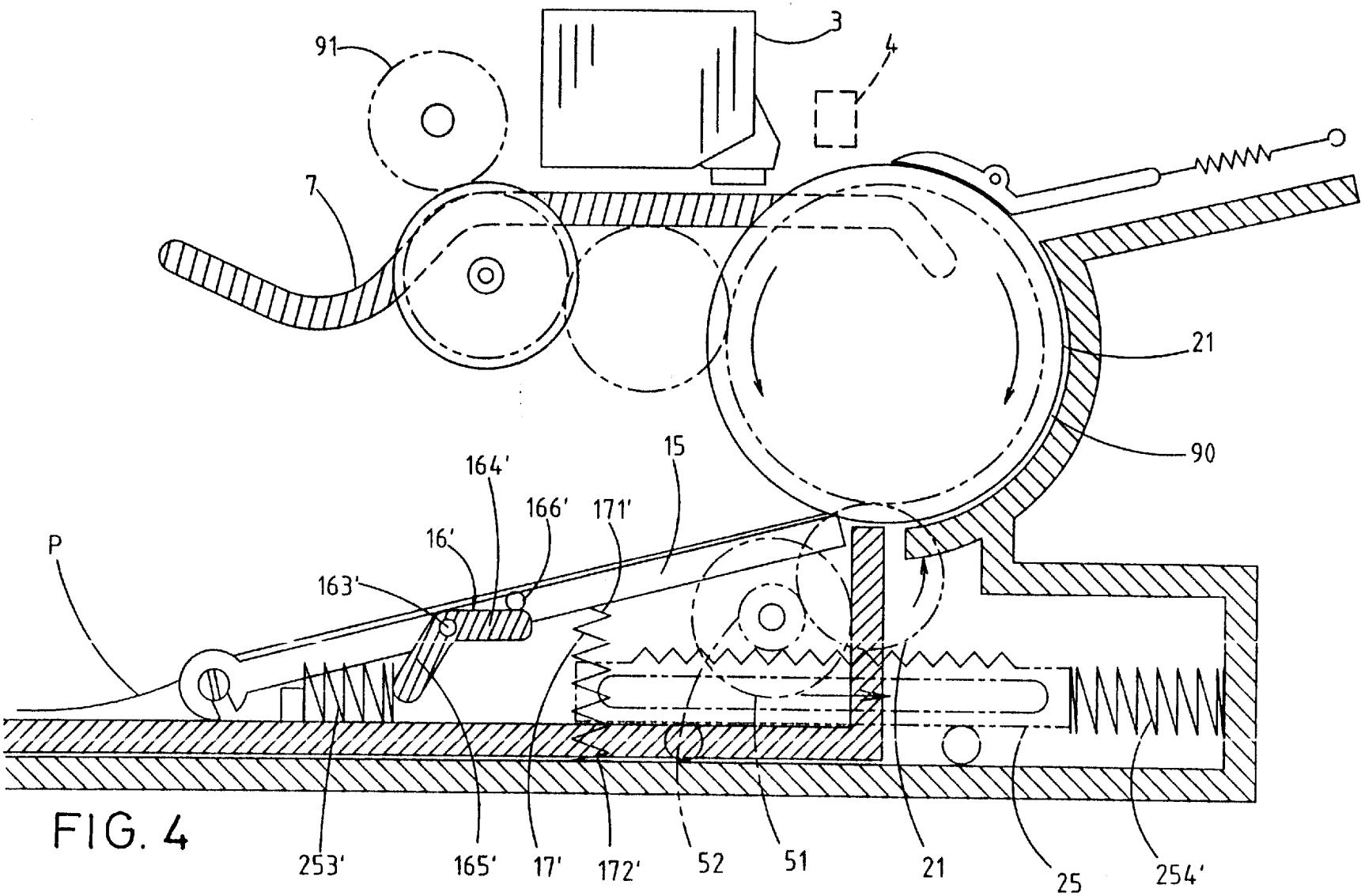
FIG. 4 is a schematic sectional view of a second preferred embodiment of the paper-feeding apparatus according to the invention when the lifting member is abutted on the feed roller to fetch a sheet of paper.
Figure 5:
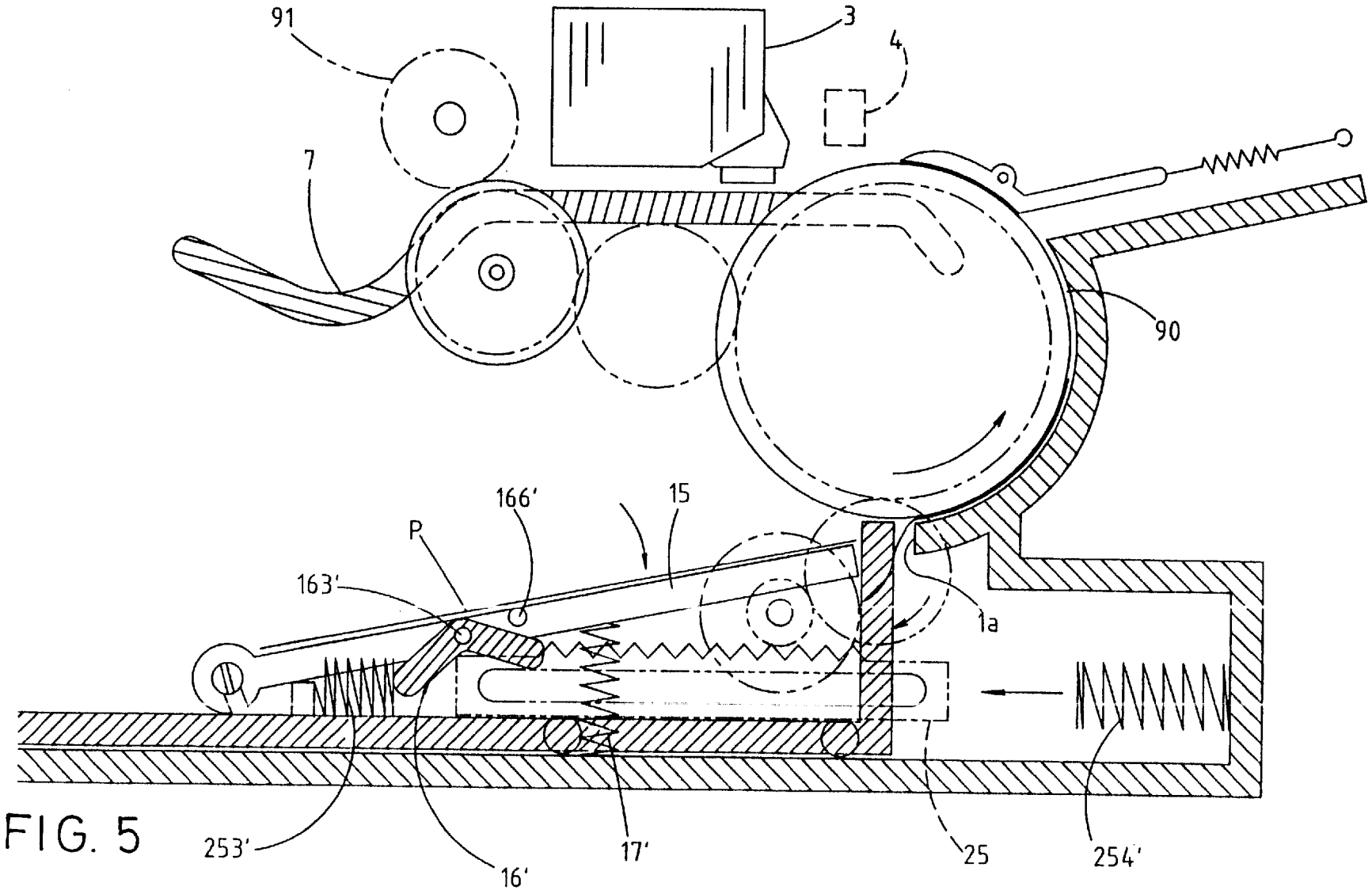
FIG. 5 shows the same of FIG. 4 when the lifting member is withdrawn from the feed roller during the feeding of the sheet through the printing position.

The second preferred embodiment of the paper-feeding apparatus according to the invention is disclosed in the following with reference to FIGS. 4–5. In these drawings, the constituent parts that are similar in structure and function to those shown in the previous embodiment of FIGS. 1–3 are labeled with the same reference numerals.

This embodiment differs from the previous one in that the actuator 16 in the first embodiment is here replaced by a pivotal member 16' and a spring 17', and the left and right stop pins 253, 254 are here replaced by a pair of stop springs 253', 254' which are mounted on both ends of the toothed bar 25. The pivotal member 16' is pivotally mounted on a shaft 163' on one side of the lifting member 15, which substantially an L-shaped member including an upper part 164' and a bottom part 165'. Further, a stop pin 166' is provided on the top of the lifting member 15 for the upper part 164' of the pivotal member 16' to abut thereon. The spring 17' has a top end 171' affixed to the bottom side of the lifting member 15, and a bottom end 172' affixed to the bottom side of the printer body 1. This allows the lifting member 15 to be urged by the spring 17' in order to constantly maintain its abutment on the feed roller 21.

When the paper sensor 4 issues a trigger signal to command the motor 51 commanding to rotate in the reverse direction, it causes the pinion gear 52 to rotate in the counterclockwise direction and the intermediate gear 27 to rotate in the clockwise direction. This then causes the feed roller 21 to rotate in the counterclockwise direction, thereby dragging the topmost sheet on the lifting member 15 into the paper guiding path 90. Meanwhile, the intermediate gear 27 drives the toothed bar 25 to shift to the left (with respect to the view of FIG. 4) until the toothed bar 25 urges against the bottom part 165' of the pivotal member 16', causing the pivotal member 16' to be pivoted about the shaft 163' in the clockwise direction. The upper 164' of the pivotal member 16' is then pivoted downwards to depart from the stop pin 166', thereby compressing the spring 17' to cause the lifting member 15 to be lowered and thus withdraw from the abutment on the feed roller 21 (see FIG. 5). This can prevent the feed roller 21 from dragging the next sheet on the lifting member 15 when the currently fed sheet P is being delivered through the printing position. When the printing on the sheet P is completed, the paper sensor 4 will issue a trigger signal to the motor 51 commanding it to rotate in the forward direction so as to rotate the pinion gear 52 in the clockwise direction, thereby causing the toothed bar 25 to be shifted to the right (with respect to the view of FIG. 4). This causes the toothed bar 25 to withdraw from its forceful abutment on the pivotal member 16', allowing the elasticity of the compressed spring 17' to be released and thereby urge upwards against the lifting member 15. This causes the lifting member 15 to move upwards until the toothed bar 25 has completely withdrawn from the abutment on the pivotal member 16'. The spring 17' then restores the lifting member 15 back to the position where the lifting member 15 is abutted on the feed roller 21. At this time, the motor 51 is triggered to rotate in the reverse direction so as to rotate the pinion gear 52 in the counterclockwise direction, causing the next sheet on the lifting member 15 to be fed into the paper guiding path 90. The toothed bar 25 shiftable only within the range defined by the left and right stop springs 253', 254'.

Third Preferred Embodiment

Figure 6:
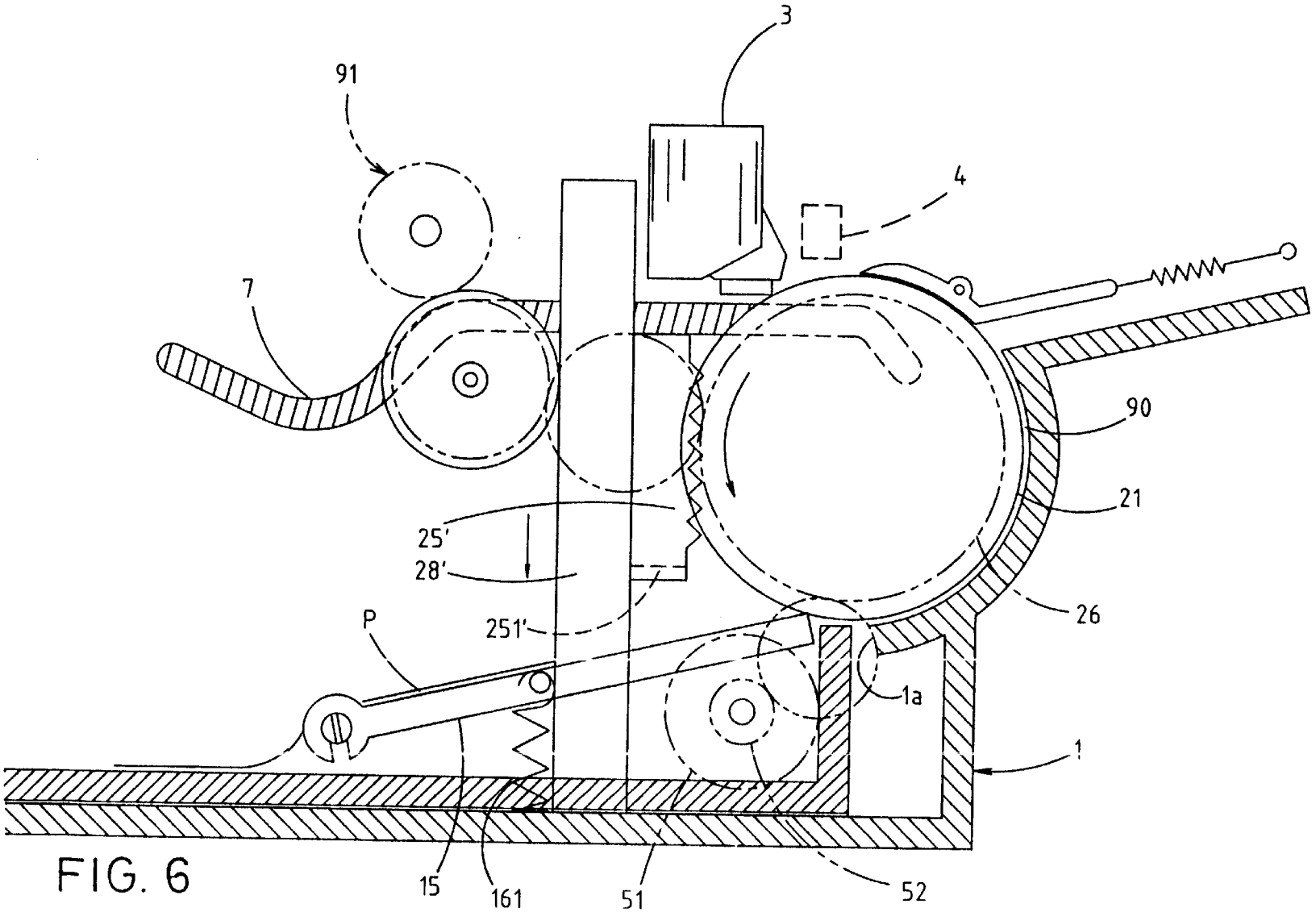
FIG. 6 is a schematic sectional view of a third preferred embodiment of the paper-feeding apparatus according to the invention when the lifting member is abutted on the feed roller to fetch a sheet of paper.
Figure 7:
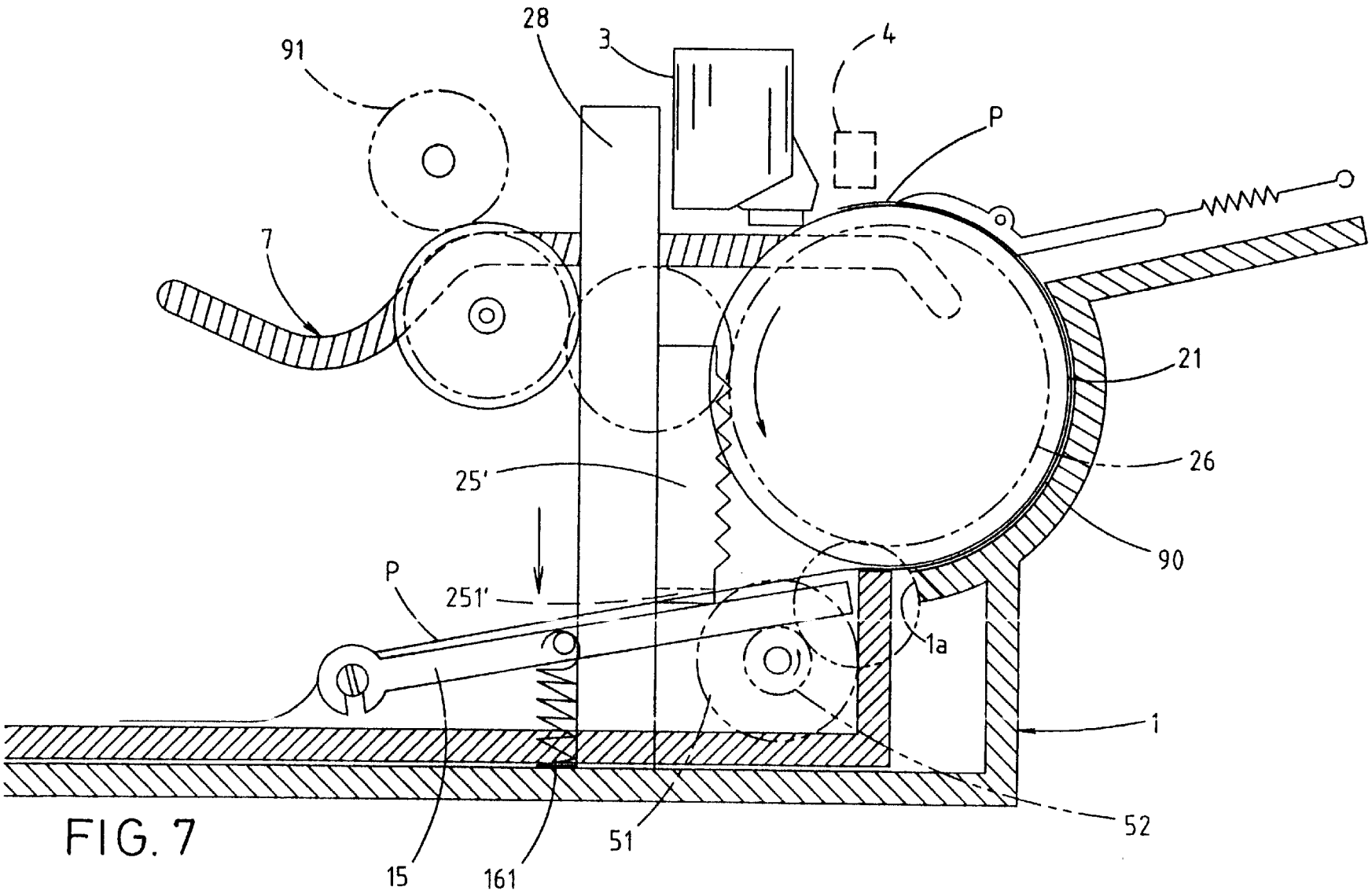
FIG. 7 shows the same of FIG. 6 when the lifting member is withdrawn from the feed roller during the feeding of the sheet through the printing position.

The third preferred embodiment of the paper-feeding apparatus according to the invention is disclosed in the following with reference to FIGS. 6–7. In these drawings, the constituent parts that are similar in structure and function to those shown in the previous embodiments are labeled with the same reference numerals.

This embodiment differs from the previous ones particularly in that the toothed bar, here designated instead by the reference numeral 25', is provided in such a manner as to be slidably mounted on a support post 28' which fixed upright on the bottom side of the printer body 1. The toothed bar 25' is meshed to the feed gear 26. A protruded portion 251' is formed on the bottom inner side of the toothed bar 25'. When the toothed bar 25' is sliding from the topmost end downwards, the protruded portion 251' thereof will urge against the lifting member 15, thereby separating the lifting member 15 from the feed roller 21. To feed in the sheet P, the paper sensor 4 issues a trigger signal to the motor 51 to command it to rotate in the reverse direction so as to rotate the pinion gear 52 in the counterclockwise direction. This then causes the feed gear 26 to rotate in the counterclockwise direction, thereby driving the toothed bar 25' to move downwards as indicated by the arrow in FIG. 6. When the toothed bar 25' is moving downwards, the protruded portion 251' thereof will urge against the lifting member 15, causing the lifting member 15 upwards to be separated from the feed roller 21. When the coil spring 161 is uncompressed, it urges the lifting member 15 to abut on the feed roller 21. The downward movement of the toothed bar 25', however, will cause the coil spring 161 to be compressed. When the sheet P has fed into the paper guiding path 90, the feed roller 21 will keep rotating in the counterclockwise direction to feed the sheet P through the printing position under the printing head 3. At, time since the lifting member 15 has been separated from the feed roller 21, the next sheet will not be dragged by the feed roller 21 (see FIG. 7). This allows the paper-feeding apparatus to feed one sheet at a time into the printing position. When the printing on the sheet P is completed, the paper sensor 4 will issue a trigger signal after a preset time to the motor 51 to command the motor 51 to rotate in the forward direction, thereby causing the pinion gear 52 to rotate in the counterclockwise direction. As a result, the toothed bar 25' is driven by the feed gear 26 to move upwards until reaching the topmost position. The paper-feeding apparatus is thus restored to the state ready to fetch the next sheet.

Fourth Preferred Embodiment

Figure 8:
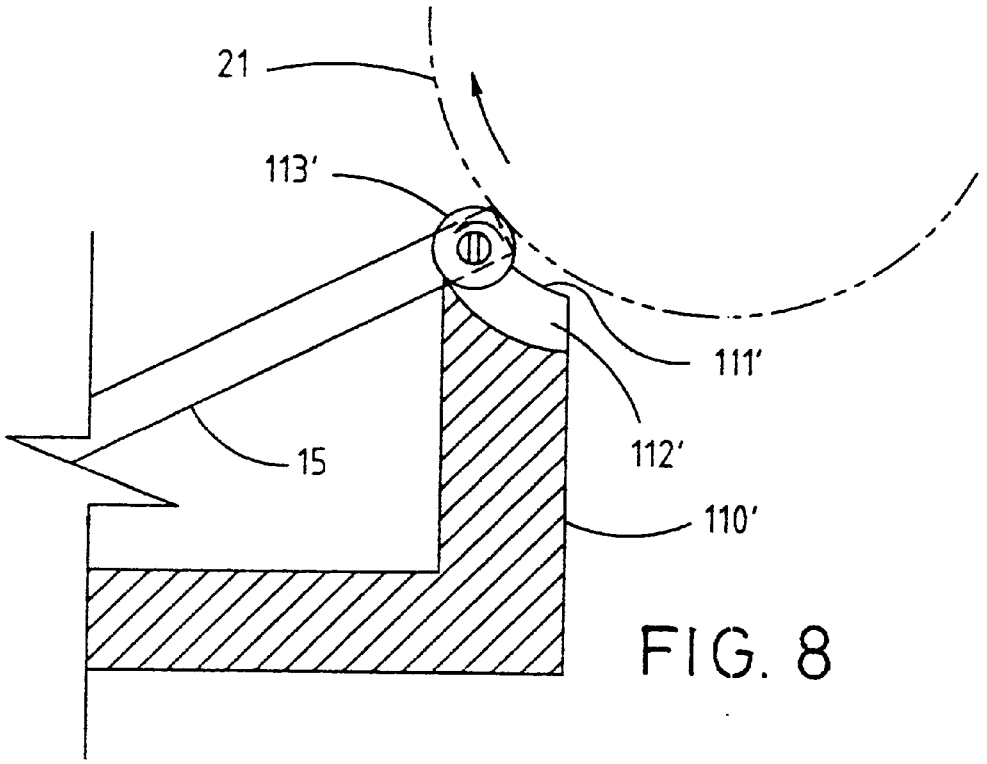
FIG. 8 is a schematic sectional view of a fourth preferred embodiment of the paper-feeding apparatus according to the invention when the lifting member is not abutted on the feed roller.
Figure 9:
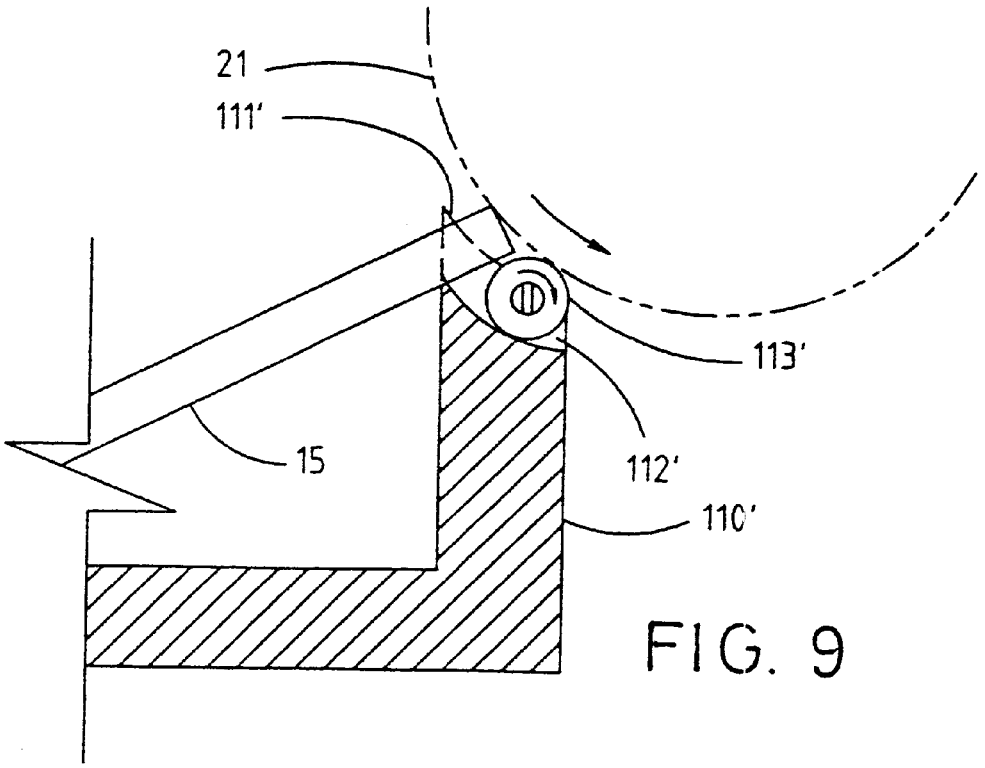
FIG. 9 shows the same of FIG. 8 when the lifting member is abutted on the feed roller to fetch a sheet of paper.

The fourth preferred embodiment of the paper-feeding apparatus according to the invention is disclosed in the following with reference to FIGS. 8–9. In these drawings, the constituent parts that are similar in structure and function to those shown in the previous embodiments are labeled with the same reference numerals.

This embodiment differs from the previous ones particularly in that this embodiment further includes a curved top side 111' formed on the top of the upright wall; at least one guide slot 112' formed in the curved the top side 111'; and a roller 13' which is slidably mounted in the guide slot 112' and can come into abutment on the feed roller 21. The curvature of the curved top side 111' is matched to the circumference of the feed roller 21. With these additional provisions, the feed roller 21, when rotating in the clockwise direction, will drive the roller 113' to rotate in the counterclockwise direction and move to the top end of the curved top side 111' of the upright wall 110' (see FIG. 8). On the other hand, when the feed roller 21 is rotating in the counterclockwise direction, it will drive the roller 113' to rotate in the clockwise direction and move to the bottom end of the curved top side 111' of the upright wall 110' (see FIG. 9). Therefore, when the paper-feeding apparatus is restored to the state ready to fetch the next sheet, the feed roller 21 is rotated in the clockwise direction, causing the roller 113' to rotate in the counterclockwise direction, thereby preventing the sheet P from being fed to between the feed roller 21 and the roller 113'. When the feed roller 21 is rotated in the counterclockwise direction, causing the roller 113' to rotate in the clockwise direction, it can help the feeding of the sheet to proceed smoothly without rumpling the sheet.

Moreover, the assembly of the guide slot 112' and the roller 113' can be mounted on the top side of the paper feeding portion 1*a* located beneath the feed roller 21 in the printer body 1.

When the sheet has undergone the printing process through the bottom of the printing head 3, it is drawn out of the paper guiding path 90 by the paper delivery mechanism 91 and then delivered to the paper receiving portion 7. This mechanism is the same as the prior art so description thereof will not be further detailed.

The invention has been described using exemplary preferred embodiments. However, it is to be understood that the scope of the invention is not limited to the disclosed embodiments. On the contrary, it is intended to cover various modifications and similar arrangements. The scope of the claims, therefore, should be accorded the broadest interpretation so as to encompass all such modifications and similar arrangements.

What is claimed is:

1. A paper-feeding apparatus, which comprises:

a paper feeding mechanism including a paper-fetching gear set, and a toothed bar meshed to said paper-fetching gear set;

motor means for driving said paper feeding mechanism;

a paper setting mechanism including a paper tray, a support shaft axially coupled to said paper tray, a lifting member pivotally coupled to said support shaft, and an actuator for driving said lifting member to move either towards or away from said paper-fetching gear set; said actuator driving said lifting member away from said paper-fetching gear set when said actuator is being urged by said toothed bar, and coming into abutment on said paper-fetching gear set when said not subjected to the urging force from said toothed bar; and a paper sensor, mounted proximate to said paper-fetching gear set, for detecting whether a sheet is being printed thereby selectively controlling said motor means to rotate in either direction.

2. The paper-feeding apparatus of claim 1, wherein said paper-fetching gear set includes:

a feed roller;

a feed gear axially coupled to said feed roller; and an intermediate gear meshed to said feed gear.

3. The paper-feeding apparatus of claim 2, wherein said intermediate gear is meshed to said toothed bar and to a pinion gear provided on the shaft of said motor means, allowing said motor means to drive said paper-fetching gear set to rotate and said toothed bar to shift.

4. The paper-feeding apparatus of claim 1, further comprising:

a plurality of pulleys mounted under said toothed bar for facilitating the shifting of said toothed bar.

5. The paper-feeding apparatus of claim 1, wherein said toothed bar is formed with a track on the bottom side thereof, which is fitted in a guide slot formed in a casing for said paper-feeding apparatus for facilitating the shifting of said toothed bar.

6. The paper-feeding apparatus of claim 1, wherein said toothed bar is formed with a guide slot in the length thereof for a pair of stop pins to be fitted therein, allowing said toothed bar to be shiftable only within a range defined by said pair of stop pins.

7. The paper-feeding apparatus of claim 1, wherein said actuator comprises a coil spring and a flexible sleeve fitted on said coil spring.

8. The paper-feeding apparatus of claim 1, wherein said actuator is an elastic cylindrical body.

9. The paper-feeding apparatus of claim 1, wherein said actuator comprises:

a pivotal member pivotally mounted on a shaft mounted on one side of said lifting member and is substantially an L-shaped member having an upper part and a bottom part; and a spring having a top end affixed to said lifting member, wherein said lifting member is formed with a stop pin on the bottom thereof for the upper part of said pivotal member to abut thereon, allowing said lifting member to be supported by said spring to constantly maintain abutment on said paper-fetching gear set.

10. The paper-feeding apparatus of claim 1, wherein said toothed bar is slidably mounted on an upright support post and meshed to said paper-fetching gear set.

11. The paper-feeding apparatus of claim 10, wherein said toothed bar is formed with a protruded portion on the bottom inner side thereof for urging downwards against said lifting member when said toothed bar is being shifted.

12. The paper-feeding apparatus of claim 1, wherein said paper tray is formed with an upright wall having a curved top side formed with at least one guide slot for a roller to be slidably mounted therein and come into abutment on the feed roller of said paper-fetching gear set; wherein when the paper-feeding apparatus is restored to the state ready to fetch the next sheet, said roller is being rotated in the clockwise direction causing said roller to rotate in the counterclockwise direction, thereby preventing the sheet from being fed between said feed roller and said roller; and when said feed roller is being rotated in the counterclockwise direction causing said roller to rotate in the clockwise direction, the fed-in sheet is prevented from being rumpled.

13. The paper-feeding apparatus of claim 1, wherein the casing for said paper-feeding apparatus is formed with a guide slot beneath said feed roller for a roller to be slidably mounted therein; wherein when said feed roller is being rotated in the clockwise direction causing said roller to rotate in the counterclockwise direction, the sheet is prevented from being fed between said feed roller and said roller, and when said feed roller is being rotated in the counterclockwise direction causing said roller to rotate in the clockwise direction, the fed-in sheet is prevented from being rumpled between said roller and said feed roller.

14. The paper-feeding apparatus of claim 1, wherein said paper sensor is a proximity sensor for detecting whether a sheet exists in the printing position.

* * * * *